US005590513A

United States Patent [19]

Belvederi

[11] Patent Number: 5,590,513

[45] Date of Patent: Jan. 7, 1997

[54] DEVICE FOR WRAPPING GROUPS OF CIGARETTES

[75] Inventor: Bruno Belvederi, S. Martino Di Monte, Italy

[73] Assignee: G. D. Societa' Per Azioni, Bologna, Italy

[21] Appl. No.: 499,021

[22] Filed: Jul. 6, 1995

[30] Foreign Application Priority Data

Jul. 13, 1994 [IT] Italy ..... B094A0329

[51] Int. Cl.[6] ..... B65B 19/24

[52] U.S. Cl. ..... 53/575; 53/149; 53/234; 53/528; 53/261

[58] Field of Search ..... 53/575, 574, 148, 53/149, 150, 151, 528, 529, 218, 225, 234, 258, 261, 257, 255

[56] References Cited

U.S. PATENT DOCUMENTS 4,616,475 10/1986 Nagata ..... 53/575
4,631,904 12/1986 Nagata ..... 53/529
4,735,032 4/1988 Focke ..... 53/149
4,862,680 9/1989 Krah ..... 53/575
5,282,527 2/1994 Etani et al. ..... 53/149 X

*Primary Examiner*—James F. Coan
*Attorney, Agent, or Firm*—Ladas & Parry

[57] ABSTRACT

On a cigarette packing machine, groups of cigarettes forming the content of respective packets are inserted inside a folding spindle and wrapped in a sheet of wrapping material which is folded on to the outer surface of the spindle before being unloaded off the spindle together with the respective group; the spindle being defined by a tubular shell, the relatively thin walls of which are reinforced internally by substantially triangular longitudinal ribs, each engaging, in use, the longitudinal gap defined by two adjacent peripheral cigarettes in the group.

5 Claims, 4 Drawing Sheets

29
33
40
46
38B
37B
35
47

1
12
15
6
16
14
13
5
23
24
43
44
34
37
37B
45
33
46
40
35
38B
31
42
38A
38
47
41
39
32
30
29
37A
21
36
45
43
22
23
20
18
17
19
11
28
15
4
2
27
3
25
26

DEVICE FOR WRAPPING GROUPS OF CIGARETTES

BACKGROUND OF THE INVENTION

The present invention relates to a device for wrapping groups of cigarettes.

In particular, the present invention relates to a wrapping device which may be used to advantage on cigarette packing machines, to which the following description refers purely by way of example.

Known packing machines normally comprise an input feedbox, from the outlet of which are withdrawn either layers of cigarettes subsequently combined into multilayer groups, or ready formed groups of cigarettes constituting the content of a packet. In general, such packing machines also comprise a first wrapping device whereby each group of cigarettes is inserted inside a folding spindle, on contacting the outer surface of which, a first sheet of wrapping material, normally consisting of foil, is folded to form the inner wrapping of the packet.

On known packing machines, each folding spindle normally comprises a tubular shell substantially in the form of a rectangular parallelepipedon, and in turn comprising flat lateral walls which, though thin, must be thick enough for the shell to withstand fairly severe stress. In view of the operating speed of modern packing machines, in fact, each folding spindle may be used for producing several inner wrappings a second, for each of which it is normally subjected to relatively severe tensile stress. On the other hand, since the inner wrapping is formed about the spindle, the respective group must be compressed inside the spindle before the sheet of wrapping material is folded, to enable the group, when extracted from the spindle, to expand elastically and so take up the slack corresponding to the thickness of the spindle walls, so that, the thicker the spindle walls are, the more each group must be compressed inside the spindle, thus increasing the risk of damaging the cigarettes in the group when forming the inner wrapping.

SUMMARY OF THE INVENTION

It is an object of the present invention to provide a wrapping device designed to overcome the aforementioned drawback, and which provides for forming inner wrappings without unduly stressing the relative groups.

According to the present invention, there is provided a device for wrapping groups of cigarettes forming the content of respective packets; the wrapping device comprising at least one folding spindle in turn comprising a tubular shell for receiving a respective said group and about which is wrapped a sheet of wrapping material; and the shell being substantially in the form of a rectangular parallelepipedon, and comprising externally flat, relatively thin walls; characterized in that at least one of said walls presents a number of inner longitudinal reinforcing ribs, preferably with a substantially triangular cross section; each rib defining, with the adjacent rib, a seat for a respective said cigarette; and each rib engaging, in use, the longitudinal gap defined by two cigarettes in the group adjacent to each other and to said wall.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figures 1, 2, 3, 4:
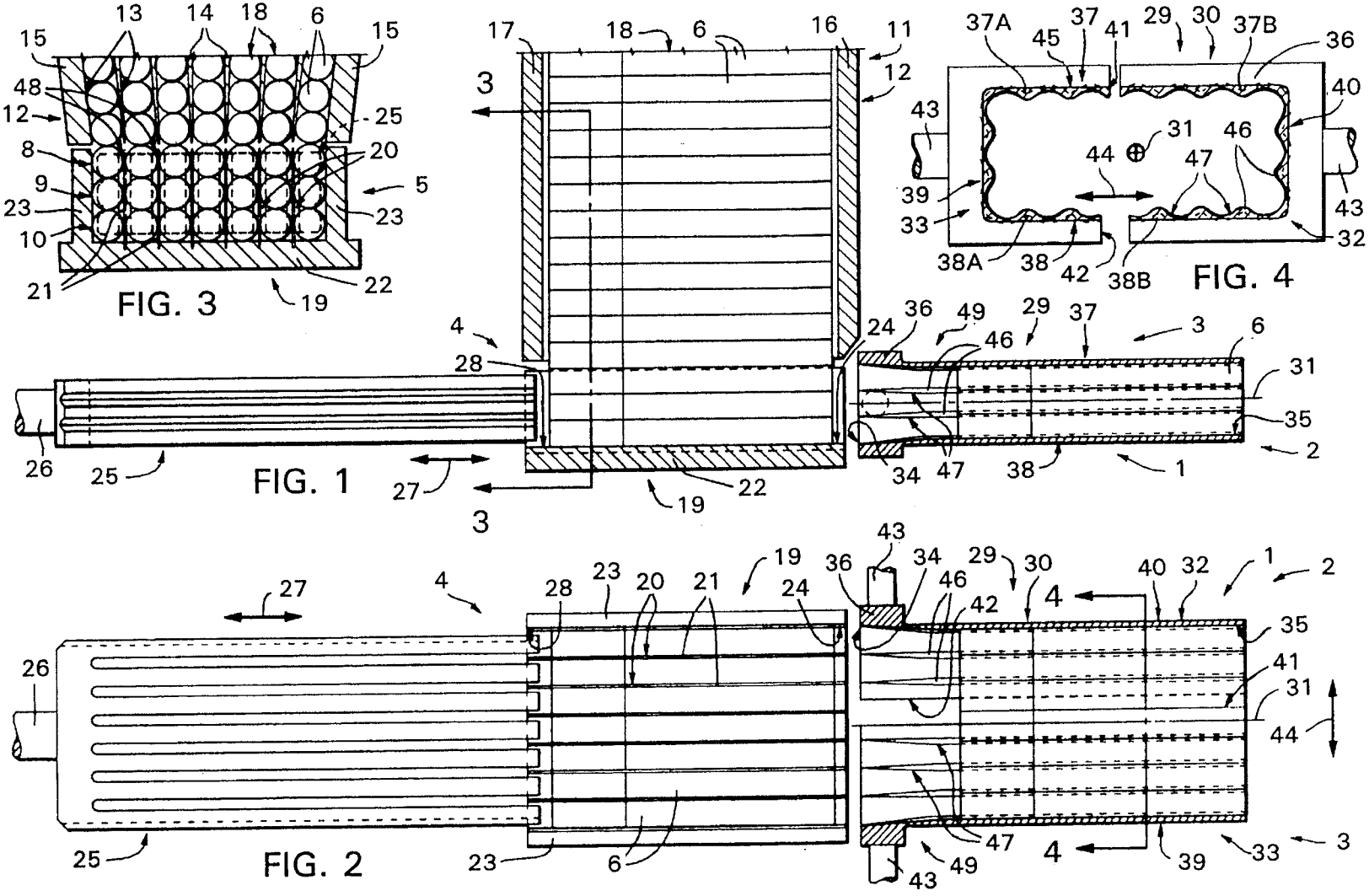
FIG. 1 shows a longitudinal section, with parts removed for clarity, of the input portion of a packing machine featuring a wrapping device in accordance with the teachings of the present invention.
FIG. 2 shows a plan view, with parts in section and parts removed for clarity, of the FIG. 1 input portion.
FIG. 3 shows a section along line III—III in FIG. 1.
FIG. 4 shows a section along line IV—IV in FIG. 2.

With reference to FIGS. 1, 2 and 3, number 1 indicates a wrapping device forming part of the input portion 2 of a packing machine 3. Within portion 2, wrapping device 1 is located downstream from a device 4 for forming groups 5 of cigarettes 6, and provides for forming, about each group 5, a wrapping 7 (FIG. 8) known as an "inner wrapping" and preferably made of foil. Each group 5 forms the content of a packet of cigarettes (not shown), and, as shown more clearly in FIG. 3, comprises three superimposed layers 8, 9, 10 of cigarettes 6, of which layer 9 is located centrally in relation to the other two.

Figures 5, 5A:
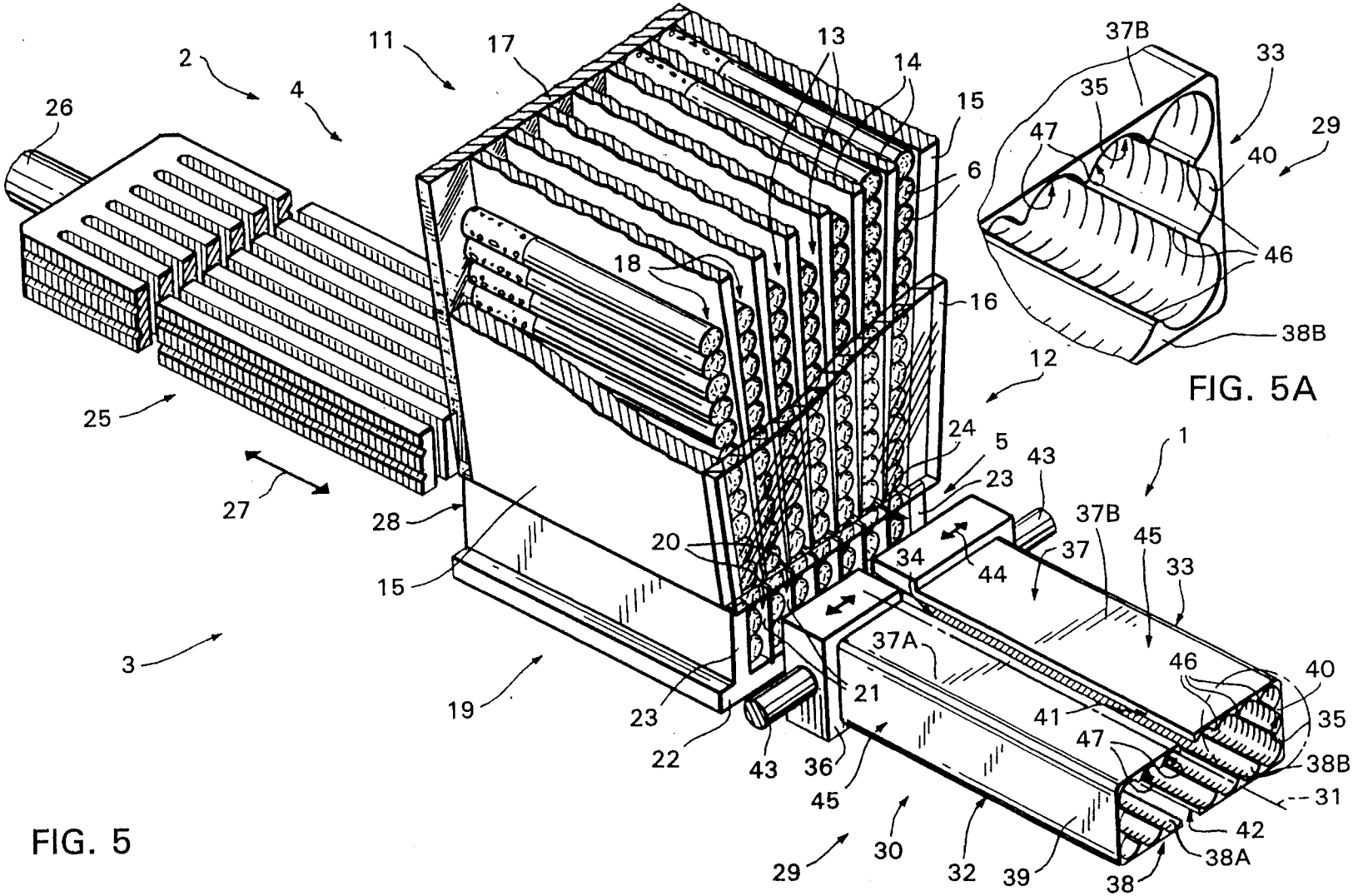
FIG. 5 shows a view in perspective, with parts in section and parts removed for clarity, of the FIG. 1 input portion.
Figure 7:
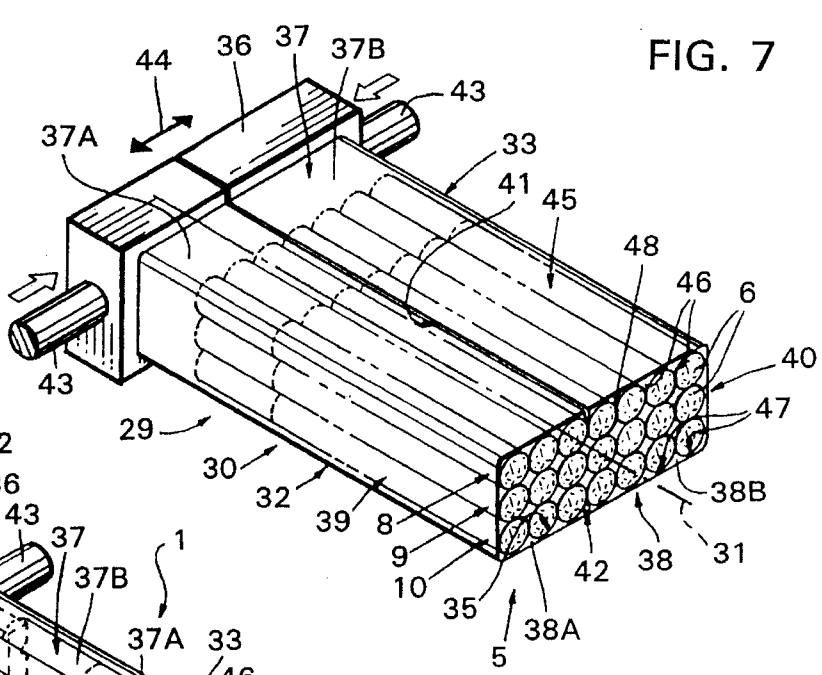
FIGS. 7 to 9 show views in perspective of a FIG. 6 detail in three different operating conditions.

As shown in FIG. 5, device 4 comprises a feedbox 11 presenting a top container (not shown), and a number of outlets 12 (only one shown), each defined by a number of side by side, substantially vertical channels 13 in turn defined by a number of side by side, substantially vertical partitions 14 which are located between two outer lateral walls 15 on either side, and are defined at the front and rear by respective transverse walls 16 and 17. Inside each channel 13, cigarettes 6 define a column 18 in which they are arranged substantially horizontally one on top of the other.

For each outlet 12, device 4 also comprises a box 19 located beneath outlet 12 so as to receive cigarettes 6, and comprising a number of channels 20 equal in number to channels 13, open on the side facing channels 13, and defined by a number of side by side partitions 21. Partitions 21 are supported at the bottom on the bottom wall 22 of box 19, and are located between two outer lateral walls 23 alongside and on either side of partitions 21, and extending upwards from wall 22. Channels 20 provide for forming cigarettes 6 into a column on wall 22 in such a manner as to form layers 8, 9, 10 and hence group 5.

Box 19 presents an opening 24 substantially aligned with and beneath wall 16 of outlet 12, and of substantially the same shape as the cross section of group 5, so as to enable group 5 on wall 22 to be expelled from box 19 in one stroke by a respective comblike pusher 25 operated by an actuator 26 so as to move back and forth in a direction 27 parallel to the axes of cigarettes 6, and through an opening 28 formed beneath wall 17 and facing opening 24, to transfer group 5 from box 19 to wrapping device 1.

Device 1 comprises a wrapping spindle 29 facing opening 24 in direction 27, and for successively receiving groups 5 of cigarettes 6. Spindle 29 in turn comprises a tubular, substantially parallelepiped shell 30 with its longitudinal axis 31 parallel to direction 27, and which is defined by two substantially U-shaped half shells 32, 33 with their concavities facing each other, and in turn defining an inlet opening 34 and an outlet opening 35. Opening 34 is located at the end of shell 30 facing opening 24 of box 19, for enabling the insertion of group 5 inside shell 30, while opening 35 is located at the other end of shell 30, for enabling group 5 to be expelled from shell 30 in direction 27.

As shown more clearly in FIG. 4, shell 30 comprises an annular flange 36 surrounding opening 34; and four walls 37, 38, 39, 40 extending from flange 36 in direction 27; walls 37 and 38 being substantially horizontal and forming the larger walls of spindle 29; and walls 39 and 40 being perpendicular to walls 37 and 38 and forming the smaller lateral walls of spindle 29. Wall 37 is divided into two parts 37*a*, 37*b* by a longitudinal slot 41 also extending through flange 36; and wall 38 is divided into two parts 38*a*, 38*b* by a slot 42 also extending through flange 36 and wider than slot 41. Slots 41 and 42 define half shells 32 and 33 of shell 30, half shell 33 being defined by walls 37*a*, 39 and 38*a*, and half shell 32 being defined by walls 37*b*, 40 and 38*b*.

Figure 6:
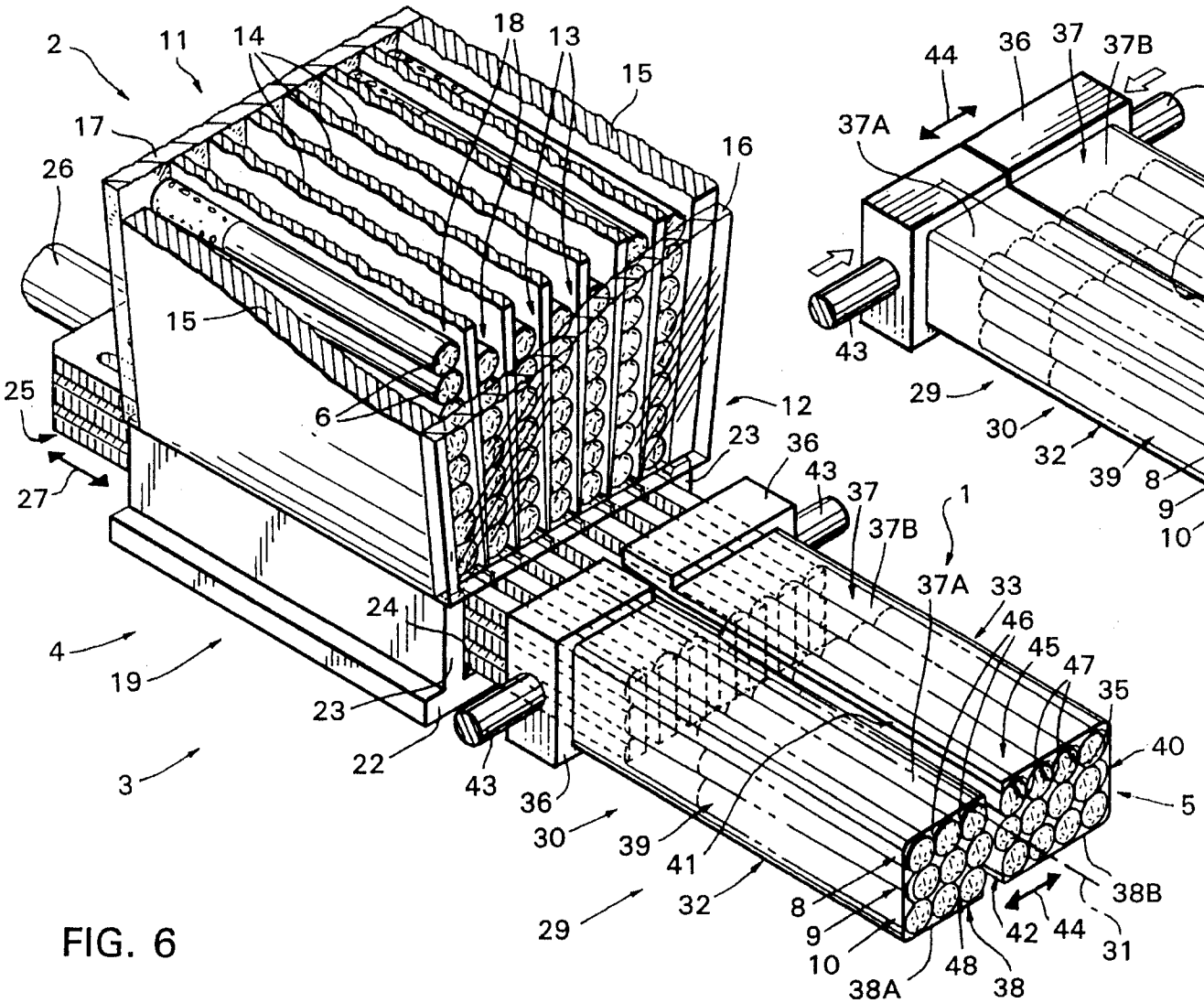
FIG. 6 shows a larger-scale view in perspective, with parts in section and parts removed for clarity, of a FIG. 1 detail in a first operating condition.

Half shells 32 and 33 are operated by respective actuators 43 so as to move back and forth in opposite directions, and in a direction 44 perpendicular to direction 27, between a group 5 loading position (FIG. 6) wherein they are separated from each other so that slot 41 presents a given width greater than zero and slot 42 presents a width smaller than the diameter of cigarette 6, and a closed position wherein half shells 32 and 33 contact each other so that the width of slot 41 is zero and slot 42 presents a minimum width.

As shown more clearly in FIG. 4, each of walls 37–40 presents a flat outer surface defining, with the outer surfaces of the other walls 37–40, a tubular outer surface 45 of shell 30, and an inner surface presenting a number of longitudinal reinforcing ribs 46 with a substantially triangular cross section and extending parallel to axis 31. Each pair of adjacent ribs 46 defines a substantially half-oval-section seat 47 for a respective peripheral cigarette 6 in group 5, and each rib 46 fits inside the gap 48 defined by two respective peripheral cigarettes 6 in group 5.

As shown in FIGS. 1 and 2, inside flange 36, half shells 32 and 33 also present an inlet and connecting portion 49 along which ribs 46 taper towards opening 34 while remaining parallel to direction 27, so that portion 49 acts as a tapered lead-in portion for each of the peripheral cigarettes 6 in group 5.

Figure 8:
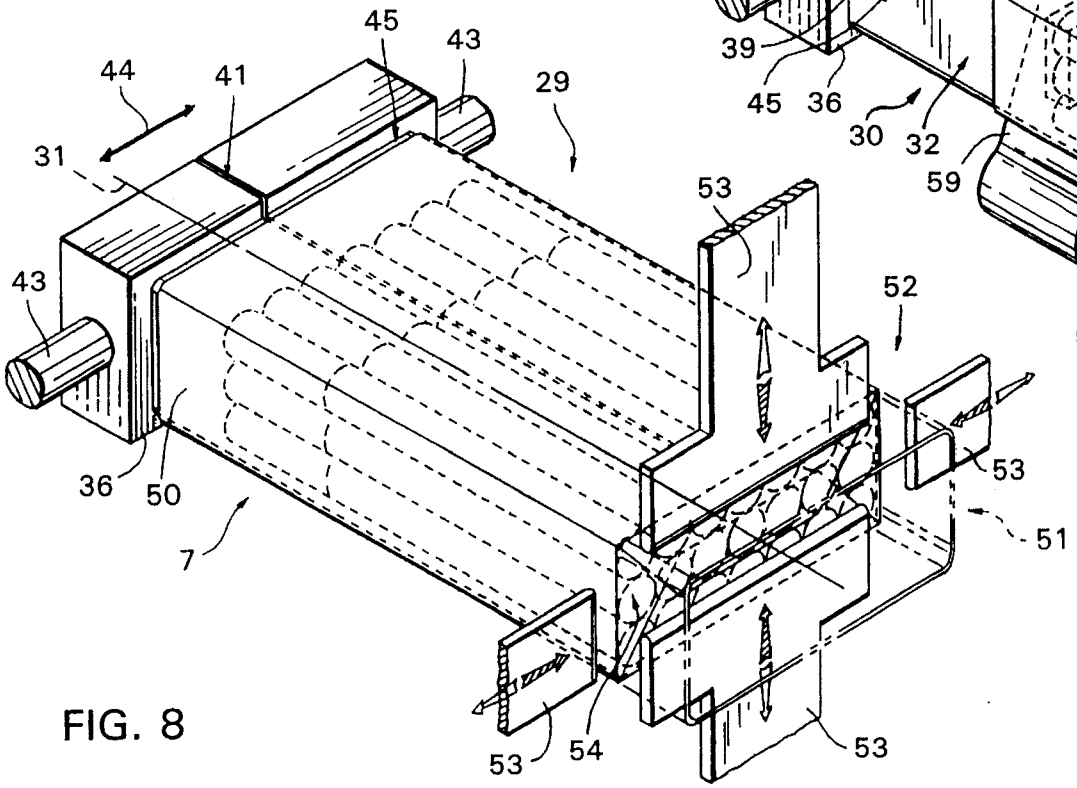

As shown in FIG. 8, device 1 also comprises a known supply device (not shown) for supplying and wrapping a sheet 50 of wrapping material about shell 30, and forming, on surface 45, a tubular wrapping 7 presenting an end portion 51 projecting beyond opening 35 of shell 30, and which is engaged by a folding assembly 52 comprising, in known manner, four folding devices 53 for engaging, in known manner, portion 51 and folding it crosswise to axis 31 to define the end wall 54 of wrapping 7.

Figure 9:
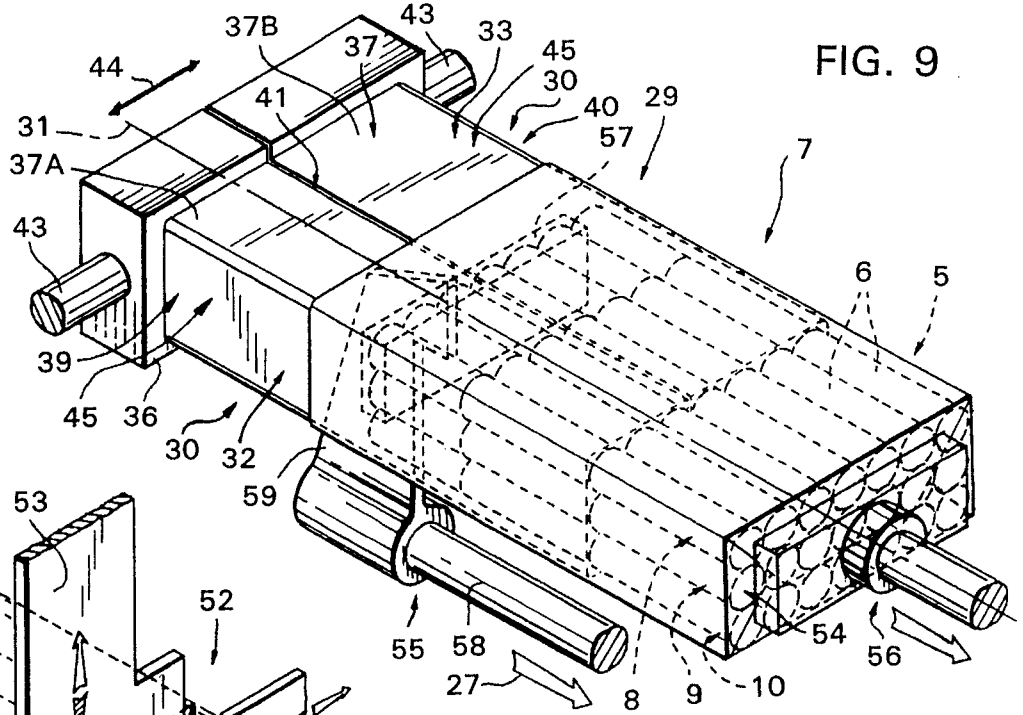

As shown in FIG. 9, device 1 also comprises a push element 55 and counterpush element 56 operated by respective actuators (not shown) so as to move back and forth in known manner in direction 27 and expel group 5 and respective wrapping 7 from spindle 29. Element 55 presents a plate 57 which is moved back and forth along axis 31 inside shell 30, and is connected to the output rod 58 of the respective actuator (not shown) by a bracket 59 extending perpendicular to wall 38 through slot 42 and of a thickness less than said minimum width of slot 42.

Operation of device 1 will now be described relative to one group 5, and as of the instant in which group 5 engages box 19, and a spindle 29 is positioned in said loading position, facing opening 24 of box 19.

As of the above condition, pusher 25 is operated to axially transfer group 5 in one stroke from box 19 to spindle 29. In this connection, it should be pointed out that, inside box 19, the cigarettes 6 in each of layers 8, 9, 10 in group 5 are aligned perfectly by partitions 21 with the corresponding cigarettes 6 in the other layers; whereas, inside spindle 29 in the loading position, i.e. with half shells 32 and 33 separated, the cigarettes 6 in intermediate layer 9 settle into a position slightly offset transversely in relation to the cigarettes 6 in layers 8 and 10. The transversely offset position of cigarettes 6 in layer 9 provides, on the one hand, for reducing the thickness of group 5 and so enabling it to fit more easily inside spindle 29, and, on the other, for maintaining cigarettes 6 in layers 8 and 10 substantially coaxial with seats 47, by virtue of the transverse shift of cigarettes 6 in intermediate layer 9 compensating for the greater width of spindle 29 in the loading position.

At this point, actuators 43 are operated to push half shells 32 and 33 together into the closed position and so gradually compress cigarettes 6 in group 5 against one another and in a direction parallel to direction 44. On account of seats 47, however, as half shells 32 and 33 are brought together, the cigarettes 6 in intermediate layer 9 are once more aligned with those of layers 8 and 10, thus further compressing cigarettes 6 in group 5 in a direction crosswise to direction 44. Once closed, spindle 29 is then wrapped in known manner inside sheet 50 to form tubular wrapping 7, which is closed in known manner at one end by folding assembly 52 before operating push element 55 and counterpush element 56, which, when positioned contacting the opposite ends of group 5, one inside and the other outside spindle 29 and wrapping 7, are both moved in direction 27 to expel group 5 and ease it on to the inner surface of wrapping 7.

As it is expelled, group 5 gradually expands to take up the space formerly occupied by shell 30 inside wrapping 7. In which connection, it should be pointed out that, in view of the relatively small amount of space to be compensated, i.e. the space occupied by shell 30, group 5 undergoes a relatively small increase in volume on leaving spindle 29. This is due to the fact that, being merely surrounding walls, walls 37–40 of shell 30 may be extremely thin, all the tensile stress applied to shell 30 being absorbed by ribs 46 occupying gaps 48 which would anyway be left vacant. A further point to note is that, in view of the thinness of walls 37–40 and consequently the small volume occupied by shell 30 inside wrapping 7, cigarettes 6 in group 5 need only be subjected to a relatively small amount of transverse compression, thus permitting yet a further reduction in the thickness of walls 37–40 and ribs 46.

Half shells 32 and 33 may of course differ from those described. For example, according to a variation not shown, the half shells may be formed by diagonally cutting opening 35 of spindle 29.

I claim:

1. A device (1) for wrapping groups (5) of cigarettes (6) forming the content of respective packets; the wrapping device (1) comprising at least one folding spindle (29) in turn comprising a tubular shell (30) for receiving a respective said group (5) and about which is wrapped a sheet (50) of wrapping material; and the shell (30) being substantially in the form of a rectangular parallelepipedon, and comprising externally flat, relatively thin walls (37–40); characterized in that at least one of said walls (37–40) presents a number of inner longitudinal reinforcing ribs (46), each engaging, in use, the longitudinal gap (48) defined by two adjacent peripheral cigarettes (6) in the group (5).

2. A device as claimed in claim 1, characterized in that each said rib (46) presents a substantially triangular cross section.

3. A device as claimed in claim 2, characterized in that each said rib (46) defines, with each adjacent rib (46), a seat (47) for a respective peripheral cigarette (6) in the group (5).

4. A device as claimed in claim 3, characterized in that each said seat (47) presents a substantially half-oval cross section.

5. A device as claimed in claim 1, characterized in that said shell (30) comprises a first and second axial slot (41, 42) dividing it into two half shells (32, 33); and actuating means (43) for transversely moving the two half shells (32, 33) back and forth, and in opposite directions, between a loading position wherein the half shells (32, 33) are separated, and a closed position wherein the half shells (32, 33) contact each other.

* * * * *